US008953418B2

(12) United States Patent
Crettex

(10) Patent No.: US 8,953,418 B2
(45) Date of Patent: Feb. 10, 2015

(54) TIMEPIECE

(75) Inventor: Frederic Crettex, Prangins (CH)

(73) Assignee: La Montre Hermes SA, Brugg Bei Biel (CH)

( * ) Notice: Subject to any disclaimer, the term of this patent is extended or adjusted under 35 U.S.C. 154(b) by 0 days.

(21) Appl. No.: 13/876,669

(22) PCT Filed: Sep. 22, 2011

(86) PCT No.: PCT/IB2011/054177

§ 371 (c)(1),
(2), (4) Date: Mar. 28, 2013

(87) PCT Pub. No.: WO2012/042448

PCT Pub. Date: Apr. 5, 2012

(65) Prior Publication Data

US 2013/0182543 A1 Jul. 18, 2013

(30) Foreign Application Priority Data

Sep. 29, 2010 (CH) ..... 1589/10

(51) Int. Cl.
*G04B 19/04* (2006.01)
*G04F 7/00* (2006.01)
*G04B 19/02* (2006.01)

(52) U.S. Cl.
CPC ..... *G04B 19/02* (2013.01)
USPC ..... 368/80; 368/101; 368/110; 368/220; 368/223

(58) Field of Classification Search
USPC ..... 368/101–106, 110, 113, 220, 80, 223
See application file for complete search history.

(56) References Cited

U.S. PATENT DOCUMENTS

| | | | | |
|---|---|---|---|---|
| 426,396 | A * | 4/1890 | Schlatter | 368/102 |
| 5,122,995 | A * | 6/1992 | Vuilleumier | 368/102 |
| 5,255,248 | A * | 10/1993 | Goodmon | 368/228 |
| 6,842,403 | B2 * | 1/2005 | Meis | 368/110 |
| 7,130,247 | B2 | 10/2006 | Brida et al. | |
| 8,398,299 | B2 | 3/2013 | Wiederrecht | |
| 8,432,772 | B2 * | 4/2013 | Meis | 368/71 |
| 2008/0151698 | A1 | 6/2008 | Gil et al. | |

FOREIGN PATENT DOCUMENTS

| | | |
|---|---|---|
| BE | 381 707 | 8/1931 |
| CH | 260 791 | 3/1949 |
| CH | 278 478 | 10/1951 |
| EP | 1 343 057 | 9/2003 |
| EP | 1 936 448 | 6/2008 |
| EP | 2 159 652 | 3/2010 |

OTHER PUBLICATIONS

International Search Report dated Dec. 6, 2011, corresponding to PCT/IB2011/054177.

* cited by examiner

*Primary Examiner* — Vit W Miska
(74) *Attorney, Agent, or Firm* — Young & Thompson

(57) ABSTRACT

A timepiece includes two hands (14, 16) advancing in superposition to display a first item of information regarding the current time. On demand, by operating a control (17), one of the two hands moves relative to the first to display a second item of information regarding the current time, the two hands returning to a superposed position when the control is released.

11 Claims, 2 Drawing Sheets

TIMEPIECE

TECHNICAL FIELD

The present invention relates to the field of timepieces, in particular mechanical. It relates more particularly to a timepiece capable of displaying an item of time information on demand by a user.

STATE OF THE ART

Watches are known that make it possible to display, on demand, an item of time information, typically the hour. In particular, certain antique watches, known by the name of "bras en l'air" comprise a movement arranged for driving an hour hand and a minute hand in retrograde manner over two respective sectors, arranged opposite each other, in such a way that they indicate the current time on demand by a user.

A timepiece is also known, from document EP2159652, that allows operation in two modes. In a first mode, the hands indicate the current time by retrograde displays. In a second mode, the hands indicate the current time only on demand, in the same way as the "bras en l'air" watches.

It will be noted that, in the operation of the "bras en l'air" watches, when the user activates the current time display, the hands move from a determined and fixed position.

The purpose of the present invention is to propose a timepiece provided with a particularly original display system, distinct from the state of the art.

DISCLOSURE OF THE INVENTION

More precisely, the invention relates to a timepiece comprising:

- two hands, driven in superposition by a movement, to display a first item of information regarding the current time,
- a control for actuating a display mechanism arranged in such a way that, when the control is engaged, one of the two hands moves relative to the first to display a second item of information regarding the current time, the two hands returning to a superposed position when the control is released.

In a preferred embodiment, a first one of the hands is mounted on a first mobile driven by the movement to display the first item of information and the second hand is mounted on a second mobile, coaxial and free with reference to the first.

Advantageously, a resilient member links the two mobiles and exerts a force tending to bring the second hand into a superposed position relative to the first.

Moreover the display mechanism of the timepiece according to the invention comprises:

- a first kinematic chain linking a cam and the first mobile,
- a second kinematic chain linking the second mobile and a drive wheel,
- a lever provided with a feeler intended to cooperate with the cam and provided with a rack intended to cooperate with said drive wheel, said lever being movably mounted in response to the action of said control.

The lever is capable of changing between a first position in which the feeler and the rack are free, with reference to the cam and the drive wheel respectively, and a second position in which the feeler and the rack cooperate with the cam and with the drive wheel respectively, to allow the second hand to display the second item of information.

According to particularly simple, convenient and economical features of the timepiece according to the invention:

- the first hand is for displaying the minute of the current time;
- the second hand is for displaying the hour of the current time;
- the gear ratio of the first kinematic chain is arranged in such a way that the cam makes eleven turns when the first mobile makes twelve turns;
- the resilient member is a spiral spring placed between the first and second mobiles; and
- the cam and the drive wheel are coaxial.

BRIEF DESCRIPTION OF THE DRAWINGS

Other details of the invention will become more clearly apparent on reading the following description, referring to the attached drawing in which.

EMBODIMENT(S) OF THE INVENTION

For the sake of clarity, the figures show only the components essential to the invention. The components of the movement within the scope of a person skilled in the art are thus not shown and are not described below, it being understood that they do not form part of the invention.

Figure 1:
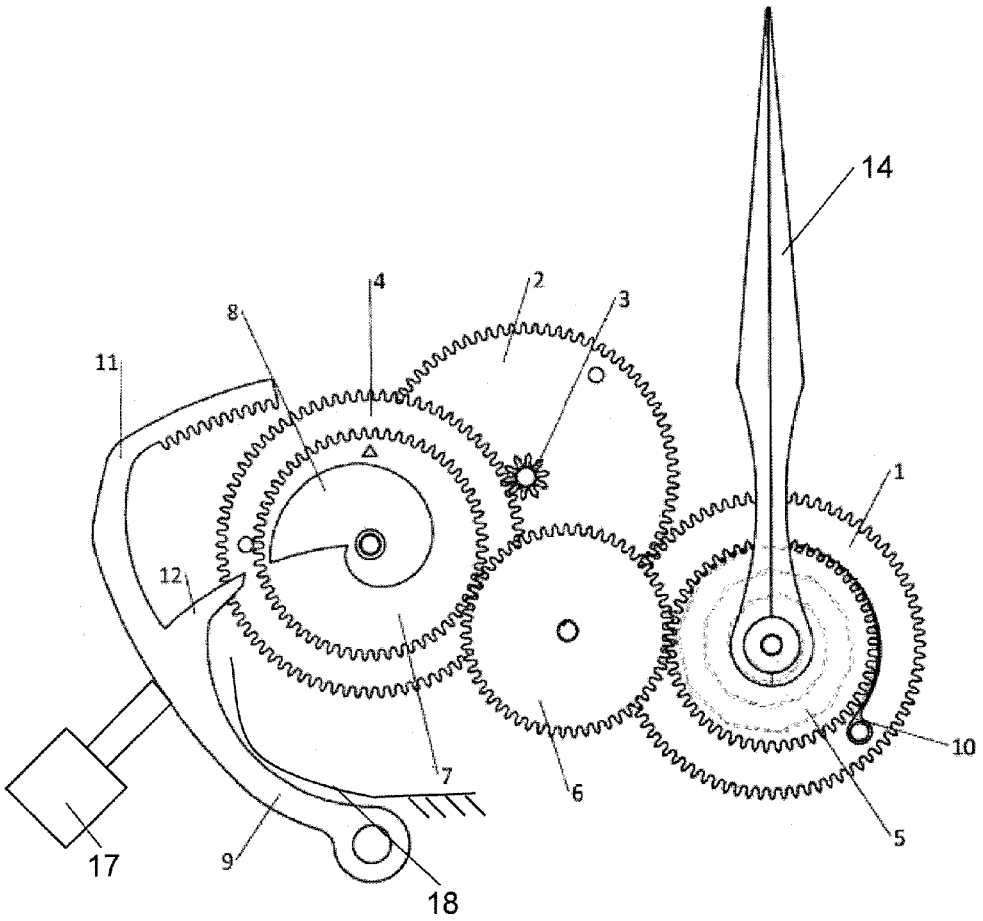
FIGS. 1 and 2 show a timepiece according to the invention, in its two states of operation respectively.

FIG. 1 shows a first hand 14 mounted on a first mobile 5 driven in rotation by the movement to display a first item of time information. In a preferred embodiment, this first item of time information is the minute of the current time and the first mobile is solidarly fixed to the cannon pinion of the movement.

Figure 2:
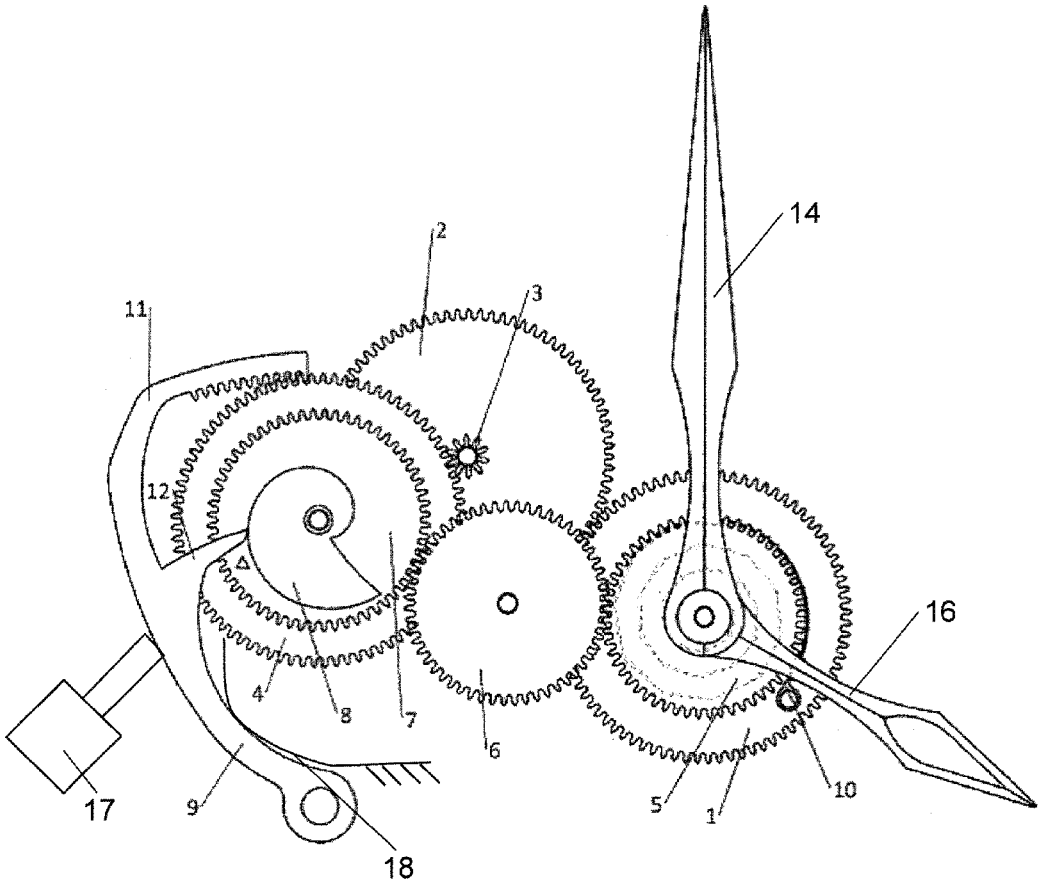

A second hand 16 is mounted on a second mobile 1, which is free on the staff of the first mobile 5. The second hand 16 has smaller dimensions than the first, so that it can be hidden under the first hand 14, as shown in FIG. 1. The second hand 16 is visible in FIG. 2, as will be understood hereafter.

A resilient member 10 is arranged to link the two mobiles and to exert a force tending to bring the second hand 16 into a superposed position relative to the first 14, so that, as in FIG. 1, only the first hand 14 is visible. Thus, the two hands 14 and 16 are driven in superposition by the movement, to display the minute of the current time. A stop, not shown in the drawing, can be arranged on the first hand 14 in order to define the position occupied by the second hand 16 with reference to the first, when it is subjected only to the action of the resilient member 10. Preferably, the resilient member 10 is a spiral spring placed between the first 5 and second 1 mobiles, the idle position of which corresponds to the superposition of the hands, which can make it possible to avoid resorting to a stop.

The timepiece according to the invention also comprises a cam 8 linked to the first mobile 5 by a first kinematic chain. The cam 8 is advantageously spiral and is fixed to a wheel 7 that meshes with a setting wheel 6, engaged with the first mobile 5.

The second mobile 1 is also linked to a drive wheel 4 by a second kinematic chain. In the preferred embodiment shown in the drawing, the drive wheel 4 is mounted coaxially but free with reference to the cam 8. The second kinematic chain can utilize an additional mobile formed by a pinion 3 meshing with the drive wheel 4 and by a wheel 2 engaged with the second mobile 1, the pinion 3 and the wheel 2 being coaxial and solidarly fixed to each other.

The figures show that the timepiece according to the invention comprises a lever 9 provided with a feeler 12, the latter being intended to cooperate with the periphery of the cam 8. More particularly, the position of the point of contact between the feeler 12 and the cam 8 is representative of a second item of time information, preferably the hour of the current time. The lever 9 is also provided with a rack 11 intended to cooperate with said drive wheel 4. The lever 9 is movably mounted in response to the action of a control 17, shown diagrammatically, and accessible by a user. The lever 9 can thus change between:

- a first position in which the feeler 12 and the rack 11 are free, with reference to the cam 8 and the drive wheel 4 respectively, and
- a second position in which the feeler 12 and the rack 11 cooperate with the cam 8 and with the drive wheel 4 respectively.

A spring 18 exerts a force on the lever 9 tending to keep it in its first position, resting against the control 17. Typically, the latter is a push button or a trigger piece mounted in the case of the timepiece. A person skilled in the art will easily be able to adapt this control, for example by adding an intermediate lever, in order to move the lever 9 far enough to bring the feeler into contact with the cam, while limiting the force exerted by the feeler on the cam. A person skilled in the art can in particular draw inspiration from the controls used in chiming mechanisms.

The force of the spring 18 can make it possible to also keep the control in its idle position. If appropriate, particularly in the case of a push button, the control can have its own return means, which makes it possible to limit the friction between the control 17 and the lever 9.

It should be noted that, in the preferred embodiment proposed in the drawing, in which the first hand is for displaying the minutes and the second hand the hour of the current time, when the control 17 is actuated, the gear ratio of the first kinematic chain is 11:12, i.e. the wheel 7, and therefore the cam 8, make 11 turns when the first mobile 5 makes 12. This is due to the fact that, when the control 17 is actuated, the starting position of the second hand 16 is the instantaneous position of the first hand 14. The positions in which the two hands are superposed are therefore taken as the reference. In this case, in twelve hours, i.e. in order for the two hands to make one complete cycle of the respective positions that they can occupy, there are eleven positions in which the hands are superposed.

Thus, when the lever 9 is in its first position, the first mobile 5 is driven by the movement, to display the minute of the current time by means of the first hand 14. The second hand 16 moves in superposition to the first and remains hidden. As all the other gears are free, the first and second kinematic chains turn freely, positioning the cam 8.

When the user actuates the control 17, the lever 9 comes into contact with the cam 8 by its feeler 12. Simultaneously the rack 11 engages with the drive wheel 4. The movement of the feeler 12 is a function of the radius of the cam 8, at the point of contact between the feeler 12 and the periphery of the cam 8. As a function of the movement of the lever 9, the second kinematic chain drives the movement of the second mobile 1 and, with it, that of the second hand 16. The ratios are determined by a person skilled in the art in such a way that, when the lever 9 is in its second position, the second hand 16 displays a second item of information, typically the hour of the current time. When the user releases the control 17, the lever 9 returns to its first position, under the effect of the spring 18. The movement of the lever 9 is thus the exact inverse of the movement carried out during the actuation of the control 17, thus allowing the second hand 16 to return to a superposed position relative to the first.

The timepiece according to the invention therefore makes it possible, in normal operation, to have only one mobile hand visible, the other being concealed, in superposition relative to the first. Preferably, the second hand 16 is hidden under the first. On demand by the user, independently of the position of the hands on actuation of the control 17, the second hand 16 moves relative to the first to display a second item of information regarding the current time, the two hands returning to a superposed position when the control 17 is freed, i.e. released.

The embodiment described above has been given as a non-limitative illustration. A person skilled in the art can provide for other variants of the invention according to his specific needs. In particular, the arrangement of the different mobiles and gears proposed is not limitative.

More generally the first hand is for displaying a predetermined reference value, and the second hand is for displaying a relative value with respect to the predetermined reference value. These values correspond to the current time, including for example the second, and/or the minute, and/or the hour, and/or the day, and/or the month, and/or the year, etc.

When the control is actuated, the gear ratio of the first kinematic chain is X:Y, i.e. the wheel, and therefore the cam, make X turns when the first mobile makes Y, where Y corresponds to the number of turns made by the fastest hand (the first hand) over a complete cycle, and X corresponds to the number of superposed positions of the hands over a complete cycle of the respective positions that they can occupy, i.e. $X=Y-1$.

For example, in a variant not shown, the first hand is for displaying the second of the current time and the second hand is for displaying the minute of the current time. If appropriate, the gear ratio of the first kinematic chain is 59:60.

In another variant not shown, the first hand is for displaying the hour of the current time and the second hand is for displaying the date of the current time (in other words a day of the month). If appropriate, and assuming for example that all the months comprise 31 days and that 12 hours are represented over 360° (i.e 24 hours over 720°), then the gear ratio of the first kinematic chain is 61:62. As a variant, assuming that 24 hours are represented over 360°, then the gear ratio of the first kinematic chain is 30:31.

In yet another variant not shown, the hands display values of the current time over different time zones, typically the hour. It is of course understood that in this case, the gear ratio is 1 and the offset between the hands is constant, corresponding to the difference in time zones.

Moreover, the timepiece according to the invention makes it possible to display an absolute value of the current time, for example for a watch, and/or to display a relative value of the current time, for example in the case of a chronograph.

Of course, even though the invention has been particularly described with reference to two kinematic chains, a person skilled in the art can combine three or more kinematic chains in a similar way.

The invention claimed is:

1. Timepiece comprising:

two hands (14, 16), driven in superposition by a movement, to display a first item of information regarding the current time, wherein the first item of information is a predetermined reference value; and a control (17) for actuating a display mechanism arranged in such a way that, when the control (17) is engaged, one of the two hands moves relative to the other to display a second item of information regarding the current time, wherein the second item of information is a relative value with respect to the predetermined reference value, and wherein the two hands return to a superposed position when the control (17) is released.

2. Timepiece according to claim 1, wherein a first (14) of the two hands is mounted on a first mobile (5) driven by the movement to display said first item of information, the second of the two hands (16) is mounted on a second mobile (1), coaxial and free with reference to the first mobile, a resilient member (10) links the two mobiles and exerts a force tending to bring the second hand (16) into a superposed position relative to the first hand, and wherein the display mechanism comprises:

a first kinematic chain linking a cam (8) and the first mobile (5), a second kinematic chain linking the second mobile (1) and a drive wheel (4), a lever (9) provided with a feeler (12) intended to cooperate with the cam (8) and provided with a rack (11) intended to cooperate with said drive wheel (4), said lever (9) being movably mounted in response to the action of said control, to change between a first position in which the feeler (12) and the rack (11) are free, with reference to the cam (8) and the drive wheel (4) respectively, and a second position in which the feeler (12) and the rack (11) cooperate with the cam (8) and with the drive wheel (4) respectively, to allow the second hand (16) to display said second item of information.

3. Timepiece according to claim 1, wherein the first of the two hands (14) is for displaying the minute of the current time.

4. Timepiece according to claim 1, wherein the second of the two hands (16) is for displaying the hour of the current time.

5. Timepiece according to claim 2, wherein the gear ratio of the first kinematic chain is arranged in such a way that the cam (8) makes eleven turns when the first mobile (5) makes twelve turns.

6. Timepiece according to claim 2, wherein the resilient member (10) is a spiral spring placed between the first and second mobiles.

7. Timepiece according to claim 2, wherein the cam (8) and the drive wheel (4) are coaxial.

8. Timepiece according to claim 2, wherein the first hand (14) is for displaying the minute of the current time.

9. Timepiece according to claim 2, wherein the second hand (16) is for displaying the hour of the current time.

10. Timepiece according to claim 3, wherein the second hand (16) is for displaying the hour of the current time.

11. Timepiece according to claim 6, wherein the cam (8) and the drive wheel (4) are coaxial.

* * * * *